United States Patent [19]

You

[11] Patent Number: 4,572,508

[45] Date of Patent: Feb. 25, 1986

[54] COMPOSITE LAMINATED BASEBALL BAT

[76] Inventor: Chin-San You, No. 3, La. 1029, Fong-Shih Rd., Fong Yuan City, Taiwan

[21] Appl. No.: 671,269

[22] Filed: Nov. 14, 1984

[51] Int. Cl.[4] ..... A63B 59/06

[52] U.S. Cl. ..... 273/72 R; 273/DIG. 23

[58] Field of Search ..... 273/72 R, 72 A, 26 B, 273/67 D, 67 DA, 67 DB, 67 DC, 67 A, 82 R, DIG. 7, DIG. 23, 67 R

[56] References Cited

U.S. PATENT DOCUMENTS

| | | | |
|---|---|---|---|
| 442,046 | 2/1890 | Heighington | 273/67 D |
| 1,063,563 | 6/1913 | May | 273/72 R |
| 1,450,646 | 4/1923 | Sadenwater | 273/72 R |

FOREIGN PATENT DOCUMENTS

| | | | |
|---|---|---|---|
| 10105 | 6/1891 | United Kingdom | 273/67 D |
| 17201 | 8/1898 | United Kingdom | 273/67 DA |

*Primary Examiner*—Richard C. Pinkham
*Assistant Examiner*—Matthew L. Schneider
*Attorney, Agent, or Firm*—Townsend and Townsend

[57] ABSTRACT

A baseball bat formed from a plurality of laminations. The laminations are held together through the engagement of dovetail shaped grooves and ridges located on the mating surfaces of the laminations. Layers of resin impregnated carbon fiber webs are sandwiched between the wooden laminations so as to provide strength and shock absorbing characteristics.

3 Claims, 2 Drawing Figures

COMPOSITE LAMINATED BASEBALL BAT

BACKGROUND OF THE INVENTION

This invention relates to a baseball bat, particularly to a baseball bat made of a combined wood and reinforced plastic material.

The earliest solid wooden baseball bat is now inclined to be superseded because of its poor strength. The baseball bat made of fiber reinforced plastics has improved characteristics of tensile stregth and bending strength, but its rigidity is less than that of the metal bat which easily causes fatigue to the user and its shock absorbing characteristics is poorer than that of the solid wooden bat.

SUMMARY OF THE INVENTION

An object of the invention is to provide a baseball bat of improved construction which offers improved shock absorbing characteristics, tensile stength, bending strength and rigidity.

This and other objects can be achieved in accordance with the invention through the provision of a baseball bat which is made of laminated wooden plates with reinforced plastic material sandwiched between them and having a tapered grip end and a head. It is characterized in that each of the wooden plates is provided with a plurality of engaging longitudinal ridges on its surface extending from the grip end to the head, each of the ridges being of a dove-tail shape in its cross-section.

The presently exemplary preferred embodiment will be described in detail with reference to the accompanying drawings, in which:

DETAILED DESCRIPTION OF THE PREFERRED EMBODIMENT

Figure 1:
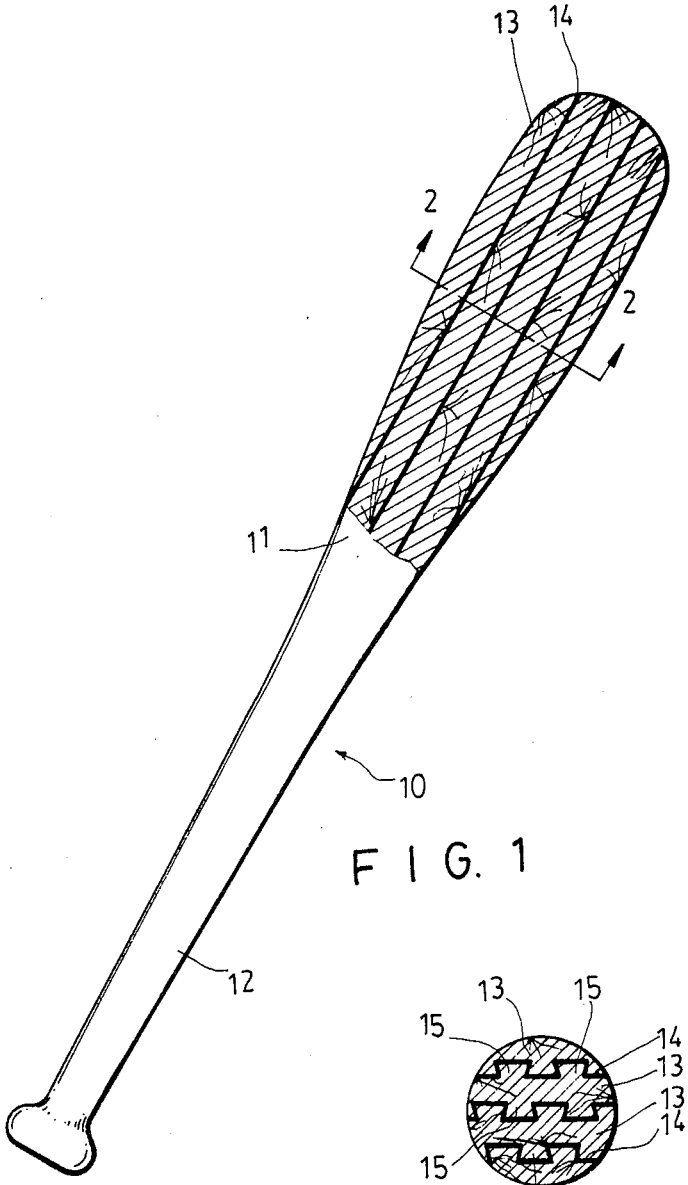
FIG. 1 is a partially sectioned view of a baseball bat constructed according to the invention.
Figure 2:
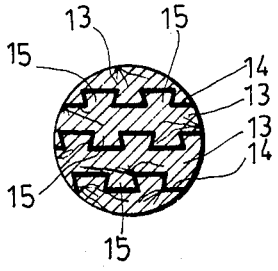
FIG. 2 is a sectioned view taken along the line 2—2 of FIG. 1.

Referring to the drawings, there is shown a baseball bat 10 which includes a hitting portion 11 and a grip portion 12. The baseball bat 10 is made of a plurality of wooden plates 13 laminated together. Between wooden plates 13 are sandwiched layers of carbon fiber webs 14 impregnated with a thermosetting resin.

Each of the wooden plates 13 is provided with a plurality of longitudinal interlocking means 15 at both of its sides. Such interlocking means 15 extends from the grip end 12 to the hitting portion and has a cross-section which is tapered at a portion adjacent to the surface of the plate 13. Preferably, the interlocking means 15 has a dovetail shaped cross-section which contributes to an effective engagement between two layers of the wooden plates 13 and the intermediate resin impregnated carbon fiber layer 14.

In manufacturing, the resin impregnated carbon fiber layers 14 are superimposed on the surfaces of the plates 13 respectively and the plates are arranged one on the other by a pressure enough to cause the interlocking means 15 to intermesh before the resin cures. After heating, wooden plates 13 are firmly bonded to one another and the formed structure is machined into a shape of a baseball bat.

With the invention thus explained, it is apparent that various modifications and variations can be made without departing from the scope of the invention. It is therefore intended that the invention be limited as indicated in the appended claims.

I claim:

1. A baseball bat comprising: a hitting portion and a tapered grip end, said bat being made of a plurality of wooden laminations, said laminations having surfaces on which are disposed interlocking means for joining the plurality of laminations together to form said bat, said interlocking means extending from said grip to said end hitting portion and being non-uniform in cross-section;

said bat further comprising at least one reinforced plastic layer interposed between said wooden laminations.

2. A baseball bat as set forth in claim 1, wherein said interlocking means comprises a plurality of interengaging protruberances and grooves of dovetail cross-sectional shape.

3. A baseball bat as set forth in claim 1 wherein said reinforced plastic material comprises a carbon fiber web impregnated with a thermosetting resin.

* * * * *